US008694298B2

(12) United States Patent
Childers et al.

(10) Patent No.: US 8,694,298 B2
(45) Date of Patent: Apr. 8, 2014

(54) DRILL STRING VALVE ACTUATOR WITH INFLATABLE SEALS

(75) Inventors: Leonard G. Childers, Katy, TX (US); Tom Griffin, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 573 days.

(21) Appl. No.: 12/713,260

(22) Filed: Feb. 26, 2010

(65) Prior Publication Data

US 2011/0209880 A1 Sep. 1, 2011

(51) Int. Cl.
*G06G 7/50* (2006.01)
*G06G 7/48* (2006.01)

(52) U.S. Cl.
USPC ..... 703/10; 703/2; 703/9

(58) Field of Classification Search
USPC ..... 703/2, 10
See application file for complete search history.

(56) References Cited

U.S. PATENT DOCUMENTS 2,723,106 A * 11/1955 Merten ..... 175/92
4,210,213 A * 7/1980 Louviere ..... 175/195
2006/0065402 A9* 3/2006 Fontana et al. ..... 166/358

* cited by examiner

*Primary Examiner* — Saif Alhija
(74) *Attorney, Agent, or Firm* — Bracewell & Giuliani LLP

(57) ABSTRACT

Method and actuator system for a Kellyguard valve disposed in a drill string. The actuator system includes a sleeve that includes a cavity; an actuator disposed inside the cavity and configured to rotate the Kellyguard valve; first and second external regions of the sleeve having plural holes configured to receive a medium under pressure for actuating the actuator; a ring provided around the first and second external regions of the sleeve and configured to be fixed, the ring having first and second internal grooves facing the first and second external regions, respectively; and first and second seals provided inside the first and second grooves, respectively, at least one of the first and second seals being configured to not touch the first or second external regions of the sleeve when in a collapsed state and to touch the first or second external regions when in an inflated state.

20 Claims, 7 Drawing Sheets

DRILL STRING VALVE ACTUATOR WITH INFLATABLE SEALS

BACKGROUND

1. Technical Field

Embodiments of the subject matter disclosed herein generally relate to methods and systems and, more particularly, to mechanisms and techniques for providing pneumatic power from a fixed part to a rotating part via an inflatable seal.

2. Discussion of the Background

During the past years, with the increase in price of fossil fuels, the interest in developing new production fields has dramatically increased. However, due to continuous exploration, the fossil fuels reserves are now found deeper and deeper either underground or undersea. The oil platforms or rigs used for deep exploration are becoming more complex. Due to these reasons, the cost of a rig is large. Thus, any maintenance aspect of the rig that requires halting the oil production and forcing the rig to stay idle is desirable to be as short as possible and as rare as possible.

One component that often requires maintenance is a drill string internal blowout preventer ("IBOP"), sometimes called a "kelly valve" or a "kelly cock." This component is used to seal off the drill string until measures can be taken to control a kick that may appear inside the drill string. An IBOP is sometimes called a "kelly valve" because, on older-style rigs, the IBOP was typically located near the "kelly," which is a non-circular part of the drill string that is used to impart rotary motion to the drill string.

A traditional BOP 10, which is shown in FIG. 1, includes a ball valve 12 or other type of valve disposed in a drill line 14. The ball valve 12 is open as shown in FIG. 1 when the drill line 14 rotates, thus allowing a fluid to circulate through the drill line 14. When necessary, the drill line 14 is stopped and the ball valve 12 is actuated to close the inside of the drill line 14, such that a portion 16 of the drill line 14 is fluidly isolated from a portion 18 of the drill line 14. To actuate the ball valve 12, the ball valve, which is connected in line with the drill string, is connected to an air source 20 as shown in FIG. 2.

The air source 20, typically a pressurized cylinder, is generally stationary. Thus, the pressurized air is provided via pipes 22 and 24 to corresponding inlets 26 and 28 to a rotating section 30. The rotating section 30 includes a fixed part 32 and a rotating part (not shown as being covered by the fixed part 32) that is fixed to the drill line 14. The pressurized air travels from the fixed part 32 to the rotating part and then exits via outlets 34 and 36. From here, the air travels via pipes 38 and 40 to an actuator 42. Actuator 42, when provided with the compressed air, closes or opens the ball valve 12, which is provided inside the drill line 14, under the actuator 42 in FIG. 2.

To minimize air loss between the fixed part 32 and the rotating part, various seals are provided on either of the parts to contact the opposite part. However, the rotation of the rotating part and the permanent contact between the seal and the rotating part makes the seal to quickly wear. A replacement seal needs to be put in place as often as two to sixteen weeks of drilling service. The replacement requires that the entire rig be shut down, which is not cost effective.

Accordingly, it would be desirable to provide systems and methods that extend the replacement period of such seals.

SUMMARY

According to one exemplary embodiment, there is an actuator system for a Kellyguard valve disposed in a drill string for gas or oil extraction. The actuator system includes a sleeve configured to be attached to the drill string and rotate together with the drill string, the sleeve including a cavity; an actuator disposed inside the cavity and configured to rotate the Kellyguard valve; first and second external regions of the sleeve, each external region having plural holes configured to receive a medium under pressure for actuating the actuator; a ring provided around the first and second external regions of the sleeve and configured to be fixed when the sleeve rotates with the drill string, the ring having first and second internal grooves facing the first and second external regions, respectively; and first and second seals provided inside the first and second grooves, respectively, at least one of the first and second seals being configured to not touch the first or second external regions of the sleeve when in a collapsed state and to touch the first or second external regions when in an inflated state.

According to another exemplary embodiment, there is a method for assembling an actuator system for a Kellyguard valve disposed in a drill string. The method includes attaching an actuator to a sleeve configured to be attached to the drill string and rotate together with the drill string; making plural holes in first and second external regions of the sleeve, each hole communicating with the actuator and being configured to receive a medium under pressure for actuating the actuator; mounting a ring around the first and second external regions of the sleeve, the ring being configured to be fixed when the sleeve rotates with the drill string, the ring having first and second internal grooves facing the first and second external regions, respectively; and inserting first and second seals inside the first and second grooves, respectively, at least one of the first and second seals being configured to not touch the first or second external regions of the sleeve when in a collapsed state and to touch the first or second external regions when in an inflated state.

According to still another exemplary embodiment, there is a method for operating a Kellyguard valve attached to a drill string. The method includes fluidly connecting an accumulator to an actuator disposed inside a sleeve configured to be attached to the drill string and rotate together with the drill string; inflating with a medium under pressure received from the accumulator first and second seals provided inside first and second grooves, respectively, of a ring provided around first and second external regions of the sleeve, the ring being configured to be fixed when the sleeve rotates with the drill string, the first and second internal grooves facing the first and second external regions, respectively; and touching with at least one of the first and second seals the first or second external regions, respectively, when in an inflated state.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a Kellyguard valve system. However, the embodiments to be discussed next are not limited to these systems, but may be applied to other systems that require the supply of compressed fluid to a piston.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a Kellyguard valve system is provided with an inflatable seal between a fixed ring and a rotatable sleeve such that the inflatable seal does not touch the rotatable sleeve while the sleeve rotates and touches the sleeve when compressed air is inflating the seal.

Figure 1:
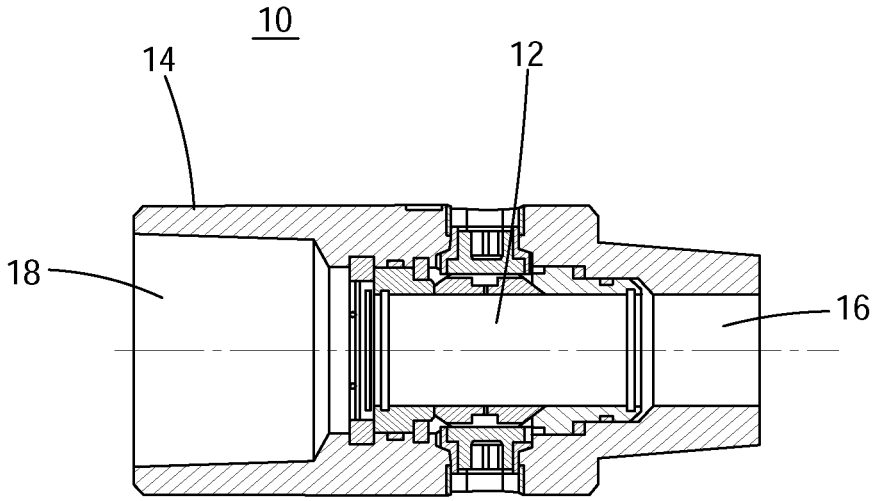
FIG. 1 is a schematic diagram of a conventional ball valve in a drill string.
Figure 2:
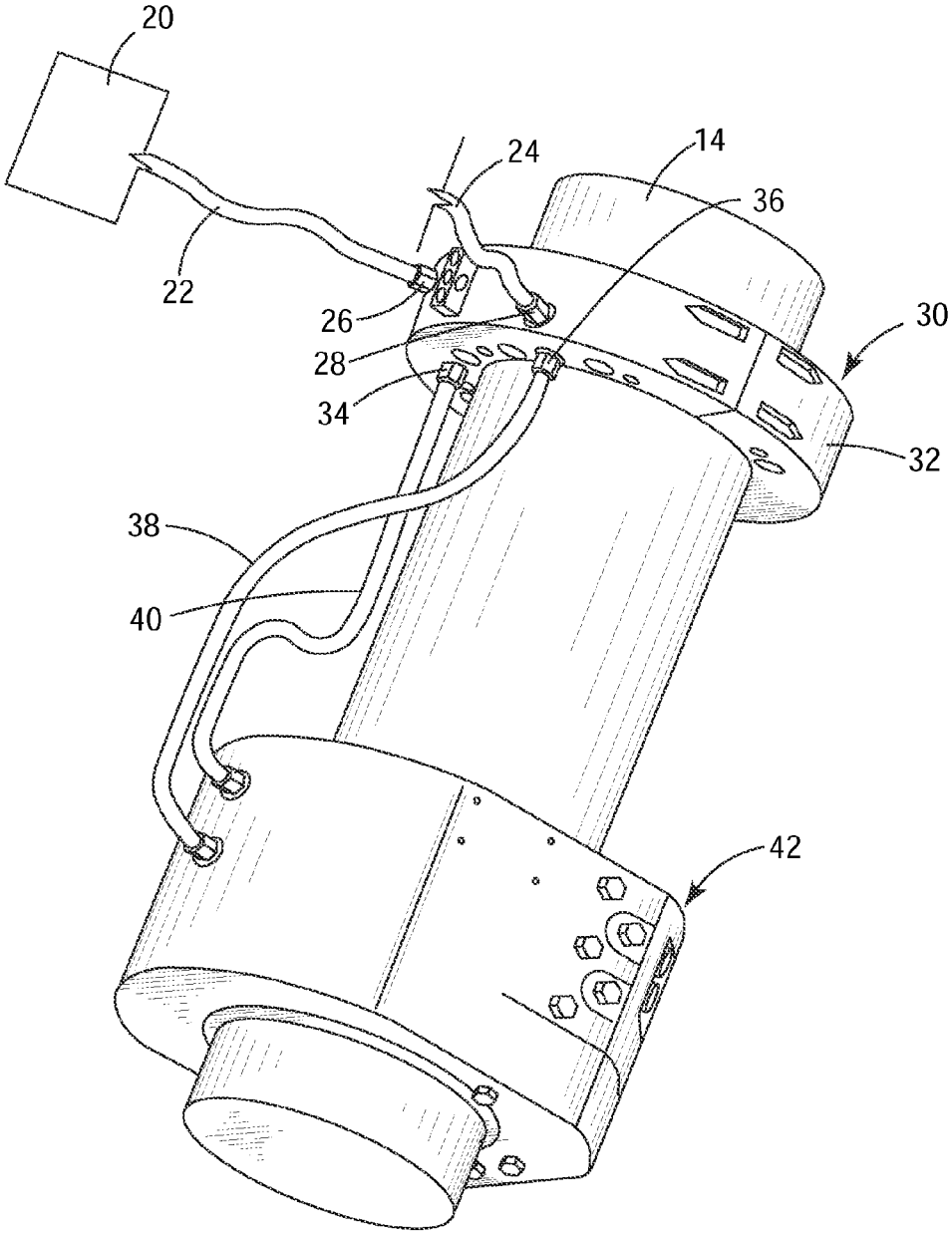
FIG. 2 is a schematic diagram of a Kellyguard valve.
Figure 3:
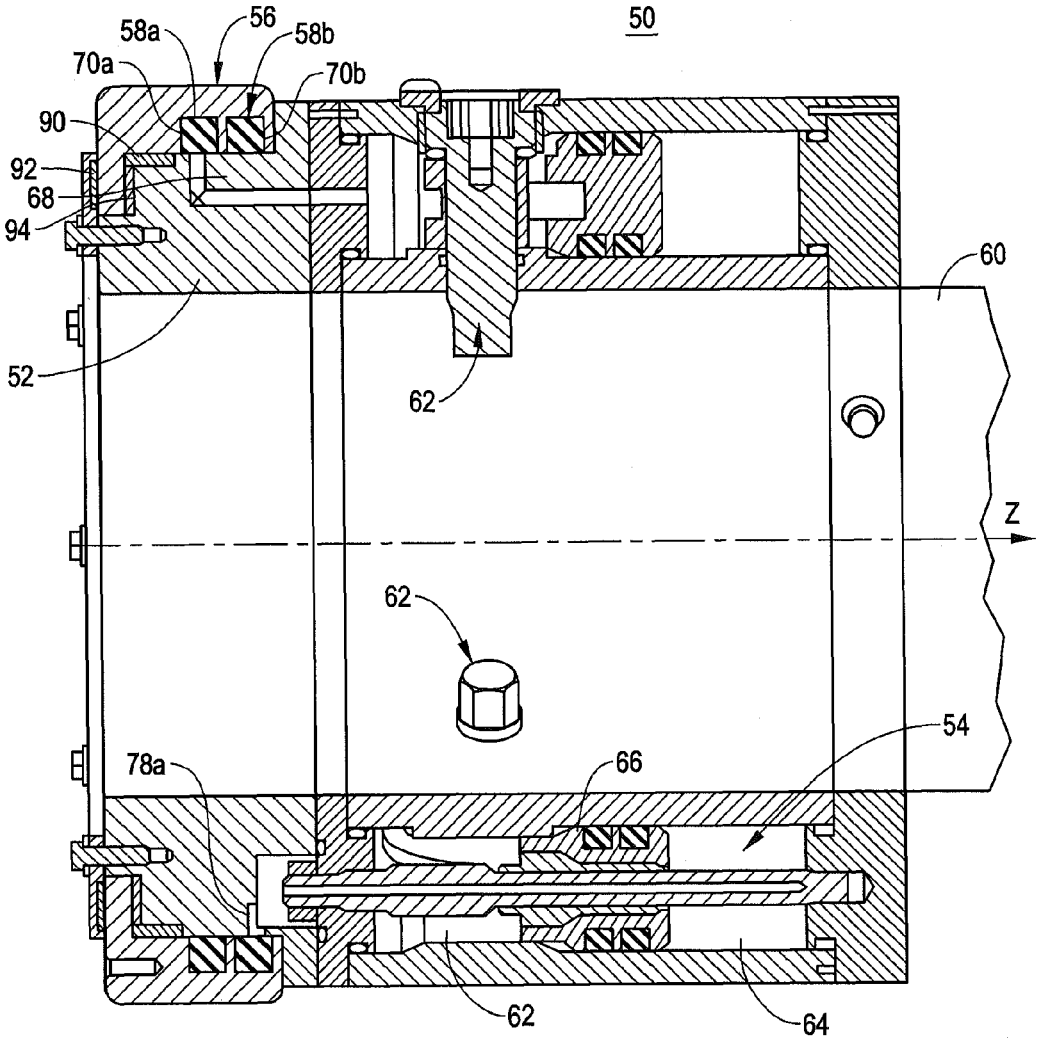
FIG. 3 is a schematic diagram of an actuator system for a Kellyguard valve according to an exemplary embodiment.

As shown in FIG. 3, a Kellyguard valve system 50 includes a valve (not shown) and an actuator system. The actuator system includes a sleeve 52, an actuator 54, a ring 56, and first and second seals 58*a* and 58*b*. Sleeve 52 is configured to be attached to a drill line 60, for example, by bolts 62. Thus, sleeve 52 rotates together with the drill line 60 when the drill line 60 is in operation. An inner profile of the sleeve 52 may be circular. In one application, the sleeve 52 completely surrounds a portion of the drill line 60.

Actuator 54 is formed in the sleeve 52. As shown in FIG. 3, actuator 54 may have two air supplies, one providing compressed air (or other medium) to a closing room 62 and the other one providing the compressed air to the opening room 64. When the compressed air is provided to the closing room 62, piston 66 moves to the right and closes the valve (not shown) and when compressed air is provided to the opening room 64, the piston 66 moves in the opposite direction and opens the valve.

The compressed air is provided to the actuator 54 from the ring 56. Ring 56 may be formed to completely surround a portion 68 of the sleeve 52. Thus, the ring 56 may have an internal profile in the shape of a circle, if the portion 68 of the sleeve 52 is circular. Because the ring 56 is stationary while the sleeve 52 rotates with the drill line 60, the following mechanism is used for transmitting the compressed air from the ring 56 to the sleeve 52.

Two grooves 70*a* and 70*b* are formed on an inside region of the ring 56. The two grooves fluidly communicate with a compressed air source (not shown), which is traditionally an accumulator. The compressed air is independently supplied to one of the two grooves 70*a* and 70*b*. Inside the two grooves, first and second seals 58*a* and 58*b* are provided. The seals 58*a* and 58*b* may be circular and may be formed in one piece to fit inside the corresponding grooves.

Figure 4:
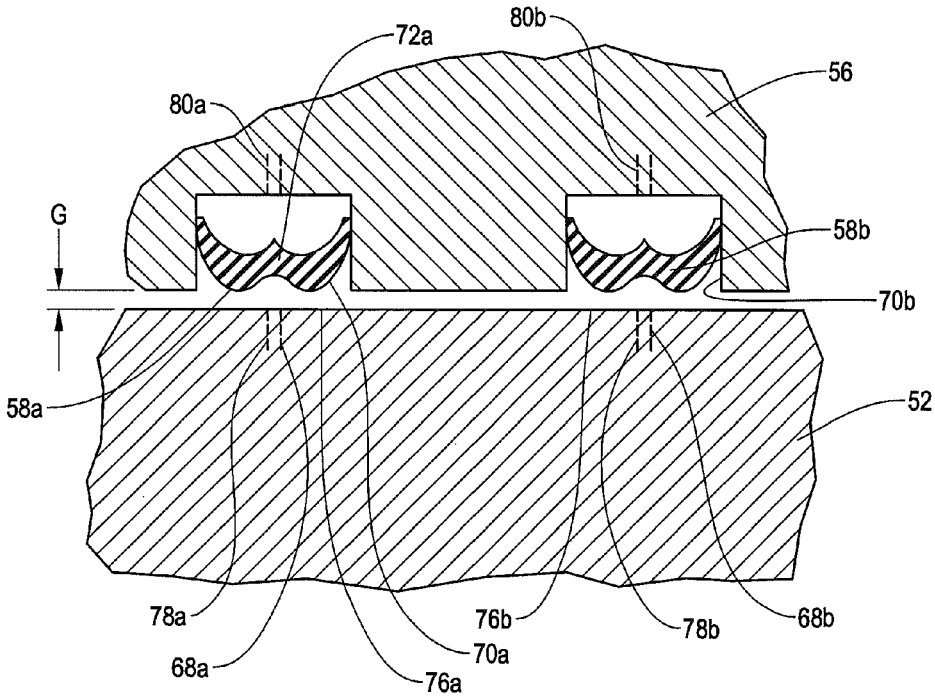
FIG. 4 is a schematic diagram of inflatable seals disposed between a ring and a sleeve of the actuator system according to an exemplary embodiment.

FIG. 4 shows in more details the seals 58*a* and 58*b* in a collapsed state. The collapsed state is defined by not supplying compressed air to the ring 56 and thus, seals 58*a* and 58*b* not being pressurized. It is noted that FIG. 4 shows a gap G between the ring 56 and the sleeve 52 and none of the seals touching a surface of the sleeve 52. FIG. 4 illustrates the case when the sleeve 52 rotates with the drill line and during this operational phase, it is undesirable to have the seals 58*a* and 58*b* to touch the sleeve 52, to reduce the wear of the seals. This is advantageous as during the operation of the drill line the actuator is not activated and the life of the seals is extended, contrary to the traditional devices.

Figure 5:
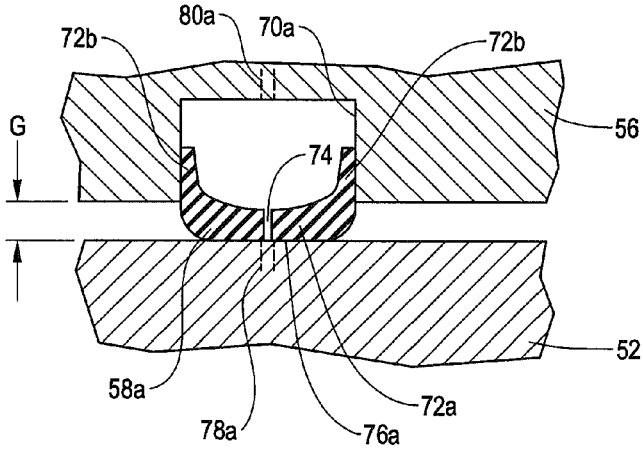
FIG. 5 is a more detailed view of an inflatable seal when in contact with a sleeve according to an exemplary embodiment.

However, when it is necessary to open or close the valve with the actuator, the rotation of the drill line is stopped and compressed air is supplied to one of the seals 58*a* and 58*b*. Because seals 58*a* and 58*b* have a certain number of holes provided in a base region 72*a*, part of the compressed air passes the seal while the remaining compressed air inflates the seal 58*a* to an inflatable state as shown in FIG. 5. Not all details of the shape of seal 58*a* are shown in FIG. 5 for clarity.

Figure 6:
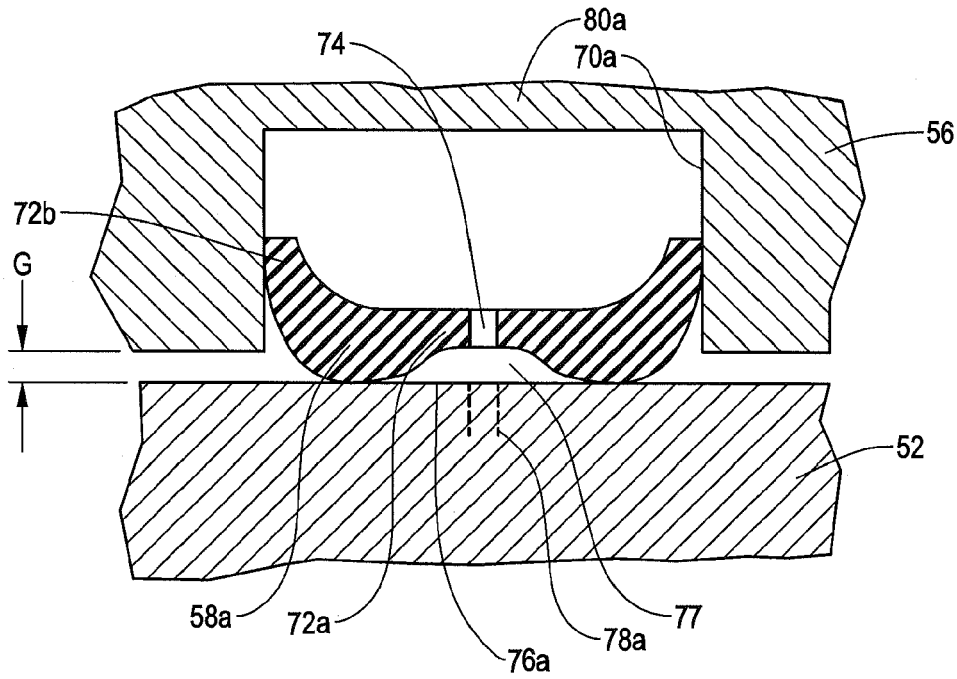
FIG. 6 is a schematic diagram of an inflatable seal in an inflatable state while contacting a sleeve according to an exemplary embodiment.

The inflatable state for seal 58*a* is defined as having sides 72*b* in contact with walls of groove 70*a*, and part of the base region 72*a* being in contact with a corresponding external region 76*a* of the sleeve 52. FIG. 6 shows in even more details the contact between the seal 58*a* and the corresponding external region 76*a* of the sleeve 52. A cavity 77 is formed between the base region 72*a* of the seal 58*a* and the corresponding external region 76*a* of the sleeve 52 while the seal 58*a* is in the inflated state.

Returning to FIG. 3, this figure also shows that one or more bearings may be provided between ring 56 and sleeve 52 for facilitating a rotation of the sleeve 52 relative to ring 56. A bearing 90 may be disposed along an axial direction Z about which the sleeve 52 rotates. Thus, bearing 90 supports a circumferential movement of the sleeve 52 relative to the ring 56. One or more bearings 92 and 94 may be provided to extend on a radial direction and these bearings ensure that there is minimal movement of the ring 56 relative to sleeve 52 along the axial direction Z.

A path of the compressed air is now described with relation to FIGS. 4-6. The compressed air is supplied from the accumulator (not shown) via an inlet 80*a* to the first seal 58*a* and via an inlet 80*b* to the second seal 58*b*. As discussed above, the air is not supplied simultaneously to the two seals 58*a* and 58*b* in this embodiment but alternately. Thus, for simplicity, the compressed air path only through seal 58*a* is discussed next.

The compressed air accumulates behind the collapsed seal 58*a* in FIG. 4, and when enough pressure is built behind the seal, the compressed air inflates the seal and presses it towards the corresponding external region 76*a* of the sleeve 52. The compressed air now escapes the inflated seal 58*a* via one or more holes 74 towards the external region 76*a*. In one application, between 2 and 10 holes are formed in the seal 58*a*. The number of holes and their size depend on the pressure to be supplied to the actuator, the size of the seal, the characteristics of the material (elastomer or other known materials for seals) of the seal, etc. Given a pressure of the compressed air, the number of holes is determined such that enough compressed air is retained behind the seal in order to be able to inflate the seal from the collapsed state to the inflated state.

The compressed air, after passing hole 74, enters into cavity 77 formed by the base region 72*a* of the seal 58*a* and the external region 76*a* of the sleeve 52. From here, the compressed air enters a channel 78*a* of sleeve 52 that communicates with actuator 54 shown in FIG. 3. Channel 78*a* is also shown in FIG. 3 for a better understanding of the air flow. It is noted with regard to FIG. 6 that the gap G between the ring 56 and the sleeve 52 is completely sealed by seal 58*a* and the cavity 77 that extends all the way around the external region 76*a* of the sleeve 52 is formed. Cavity 77 allows the compressed air that exits from hole 74 to be guided to holes 78*a* as these holes 78*a* are formed at certain intervals one from the other on the periphery of the external region 76*a* of the sleeve 52.

In this way, seals 58*a* and 58*b* between the ring 56 and the sleeve 52 do not experience any wear during the rotation of the sleeve 52 with the drill line 60 as the seals are in a collapsed state inside grooves 70*a* and 70*b*, which extends the life of the seals. The seals contact corresponding external regions of the sleeve when the sleeve is stationary and the compressed air inflates the seals from the collapsed state to the inflated state.

Figure 7:
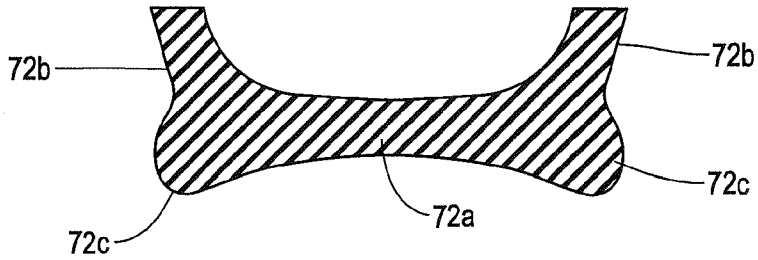
FIG. 7 is a schematic diagram of an inflatable seal according to another exemplary embodiment.

According to another exemplary embodiment, the profile of the seals 58*a* and 58*b* may be shaped such that connecting parts 72*c* between the sides 72*b* and the base region 72*a* have almost a circular exterior shape, as shown in FIG. 7. The connecting parts 72*c* may behave according to this exemplary embodiment similar to two O-rings.

Figure 8:
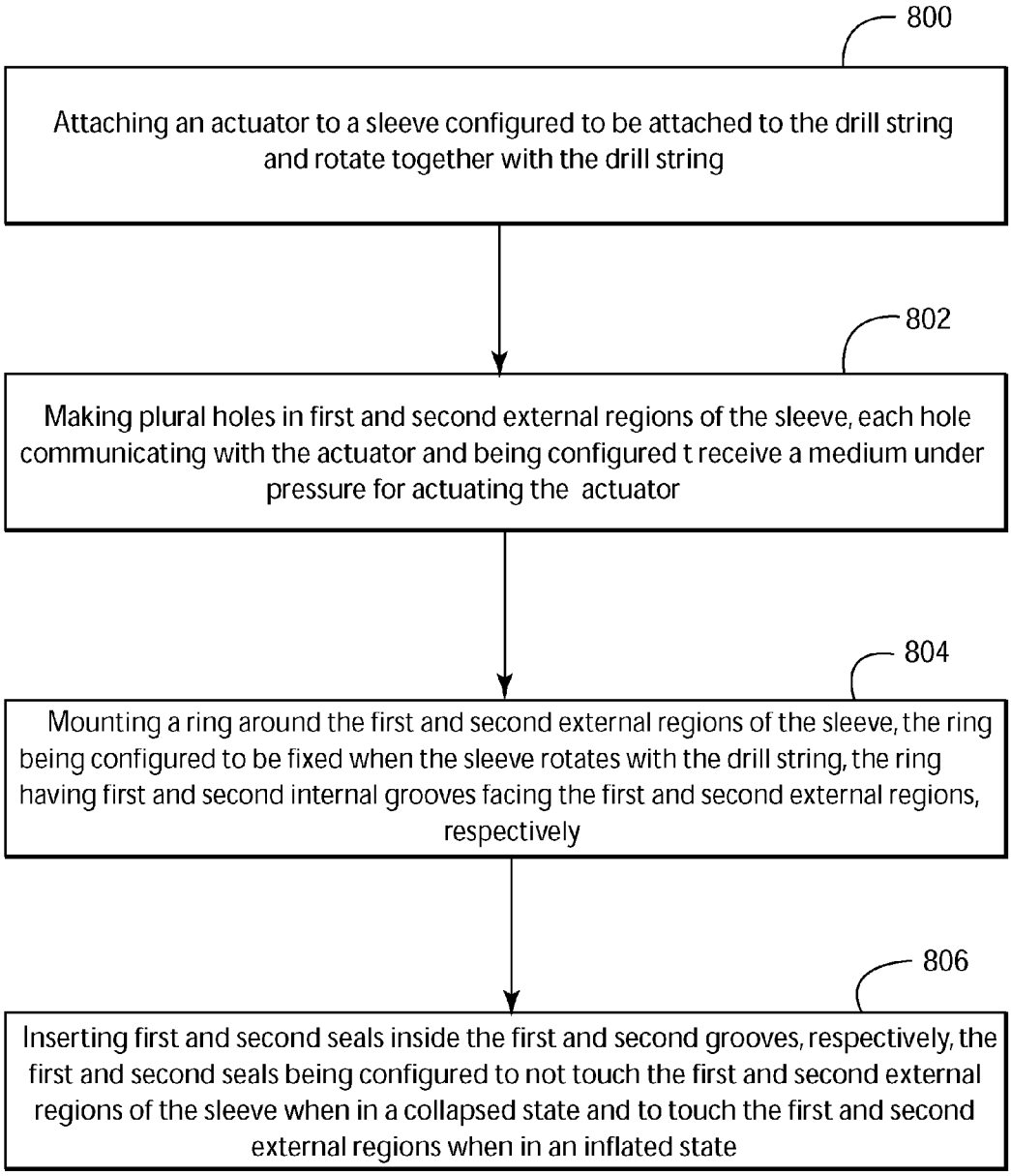
FIG. 8 is a flow chart illustrating a method for assembling an actuator system with an inflatable seal according to an exemplary embodiment.

According to an exemplary embodiment, illustrated in FIG. 8, there is a method for assembling an actuator system for a Kellyguard valve disposed in a drill string. The method includes a step 800 of attaching an actuator to an sleeve configured to be attached to the drill string and rotate together with the drill string, a step 802 of making plural holes in first and second external regions of the sleeve, each hole communicating with the actuator and being configured to receive a medium under pressure for actuating the actuator, a step 804 of mounting a ring around the first and second external regions of the sleeve, the ring being configured to be fix when the sleeve rotates with the drill string, the ring having first and second internal grooves facing the first and second external regions, respectively, and a step 806 of inserting first and second seals inside the first and second grooves, respectively. The first and second seals being configured to not touch the first and second external regions of the sleeve when in a collapsed state and to touch the first and second external regions when in an inflated state.

Figure 9:
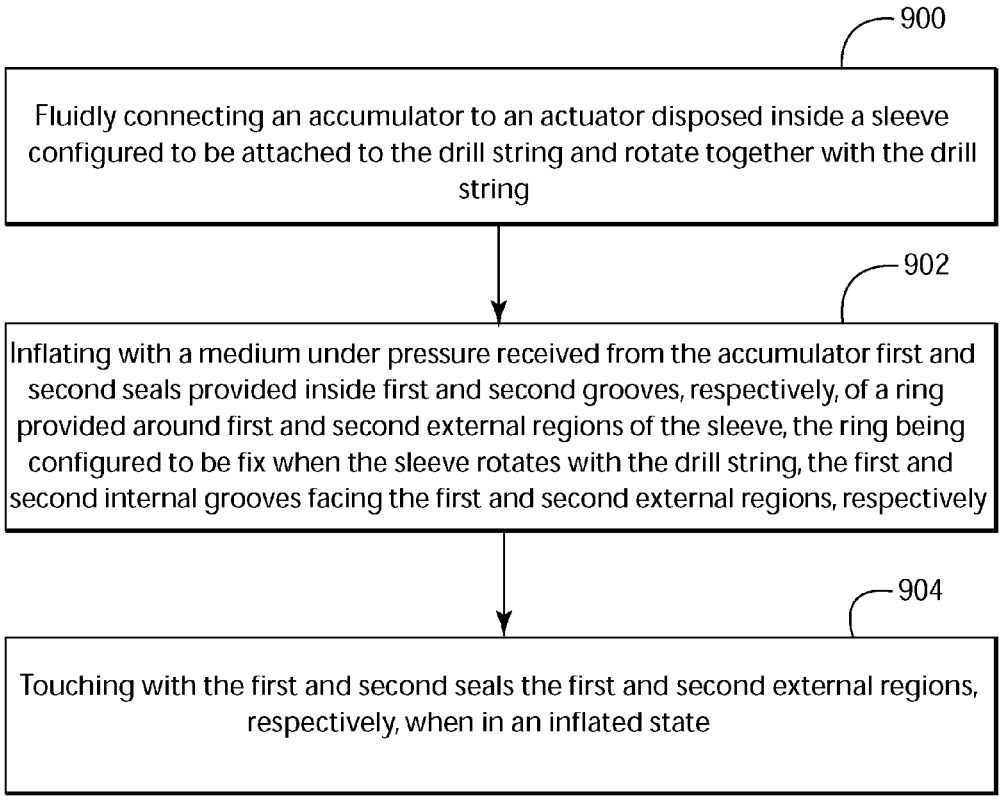
FIG. 9 is a flow chart illustrating a method for operating an actuator system with an inflatable seal according to an exemplary embodiment.

According to another exemplary embodiment shown in FIG. 9, there is a method for operating a Kellyguard valve attached to a drill string. The method includes a step 900 of fluidly connecting an accumulator to an actuator disposed inside an sleeve configured to be attached to the drill string and rotate together with the drill string, a step 902 of inflating with a medium under pressure received from the accumulator first and second seals provided inside first and second grooves, respectively, of a ring provided around first and second external regions of the sleeve, the ring being configured to be fix when the sleeve rotates with the drill string, the first and second internal grooves facing the first and second external regions, respectively, and a step 904 of touching with the first and second seals the first and second external regions, respectively, when in an inflated state.

The disclosed exemplary embodiments provide a system and a method for providing a seal having a long operating life for a Kellyguard valve system. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An actuator system for connection into a drill string for gas or oil extraction, the actuator system comprising:

a housing having a longitudinal axis and configured to be attached to the drill string and rotate together with the drill string;

an actuator within the housing to perform a function in response to fluid pressure;

a cylindrical external region on the housing;

at least one actuating fluid passage leading from a chamber within the housing to an inlet on the external region;

a ring provided around the external region of the housing and configured to be fixed against rotation when the housing rotates with the drill string, the ring having at least one circumferential internal groove surrounding the external region radially outward from the inlet, the groove having a base wall spaced radially outward from the external region;

a supply fluid port extending from an exterior portion of the ring through the ring to the groove;

an annular seal provided inside the groove, the seal having an outer diameter side facing the base wall inward from the supply fluid port and an inner diameter side facing the external region, the seal having at least one transverse hole extending transverse to the longitudinal axis through the seal from the outer diameter side to the inner diameter side, the supply fluid port, the transverse hole, and the actuating fluid passage being in fluid communication with each other; wherein, the seal has a disengaged position with the inner diameter side spaced radially outward from the external region of the housing and an engaged position with the inner diameter side sealingly engaging the external region of the housing; and fluid under pressure applied to the supply fluid port in the groove in the ring causes the seal to contract and move from the disengaged position to the engaged position, the fluid flowing from the supply fluid port through the transverse hole and into the actuating fluid passage to cause the actuator to move to perform the function.

2. The actuator system of claim 1, wherein removing the fluid under pressure from the supply fluid port allows the seal to resiliently move back to the disengaged position.

3. The actuator system of claim 1, wherein:

the groove has side walls that join the base wall; and the seal has side edges that sealingly contact the side walls while in the disengaged and the engaged positions and sealingly slide against the side walls while the seal moves from the disengaged to the engaged position.

4. The actuator system of claim 1, wherein while in the disengaged position:

the inner diameter side of the seal has two annular and parallel convex regions, and the transverse hole joins the inner diameter side between the convex regions.

5. The actuator system of claim 1, wherein while in the disengaged position, the inner diameter side of the seal comprises:

annular lobes, the lobes being parallel convex surfaces protruding radially inward toward the external region of the housing;

an annular valley spaced between the lobes, the valley being a concave surface with an inner diameter greater than inner diameters of the lobes; and wherein the transverse hole extends to the valley.

6. The actuator system of claim 5, wherein while fluid under pressure is applied to the fluid port in the ring:

the lobes sealingly contact the external region on the housing above and below the inlet of the actuating fluid passage; and the valley defines an annular cavity surrounding the external region.

7. The actuator system of claim 1, wherein while in the disengaged position, the outer diameter side of the seal comprises:

annular side-by-side concave surfaces;

an annular intermediate region between the concave surfaces, the intermediate region being convex and having an outer diameter greater than outer diameters of the concave surfaces; and wherein the transverse hole extends through the intermediate region.

8. The actuator system of claim 1, wherein:

the inner diameter side of the seal is recessed within the groove while in the disengaged position and protrudes radially inward from the groove while in the engaged position.

9. The actuator system of claim 1, further comprising:

plural bearings provided between the ring and the housing to facilitate a rotation of the housing relative to the ring.

10. The actuator system of claim 9, wherein at least one bearing of the plural bearings is cylindrical and the other is flat.

11. The actuator system of claim 1, wherein the function performed by the actuator is to open and close a ball valve.

12. The actuator system of claim 1, wherein an annular portion of the seal from the outer diameter side to the inner diameter side is solid and free any internal cavities other than the transverse hole.

13. An actuator system for connection into a drill string for gas or oil extraction, the actuator system comprising:

a housing having a longitudinal axis and upper and lower threads for connection into and rotation with the drill string;

an actuator within the housing to perform a specified function in response to fluid pressure;

a cylindrical external region on the housing;

an actuating fluid passage leading from a chamber within the housing to an inlet on the external region;

a ring provided around the external region of the housing and configured to be fixed against rotation when the housing rotates with the drill string, the ring having a circumferential internal groove surrounding the external region and spaced radially outward from the inlet, the groove having upper and lower side walls joined by a base wall that is spaced radially outward from the annular opening;

a supply fluid port extending from an exterior portion of the ring through the ring to the base wall of the groove;

an annular seal provided inside the groove, the seal having an outer diameter side facing the base wall and an inner diameter side facing the external region, the seal having an upper edge sealingly engaging the upper side wall and a lower edge sealingly engaging the lower side wall, the seal having a plurality of transverse holes extending through the seal transverse to the longitudinal axis from the outer diameter side to the inner diameter side, the transverse holes being in fluid communication with the actuating fluid passage and with the supply fluid port; wherein, the seal has a disengaged position with the inner diameter side spaced radially outward from the external region of the housing and an engaged position with the inner diameter side sealingly engaging the external region of the housing; and fluid under pressure applied to the supply fluid port causes the seal to contract and move from the disengaged position to the engaged position, the fluid flowing from the supply fluid port, through the transverse holes and into the inlet of the actuating fluid passage to cause the actuator to perform the specified function.

14. The actuator system of claim 13, wherein the seal from the outer diameter side to the inner diameter side is solid and free any internal cavities other than the transverse holes.

15. The actuator system of claim 13, wherein while in the disengaged position:

the inner diameter side of the seal has two side-by-side annular convex lobes separated by a valley; and wherein the transverse holes extend to the valley.

16. The actuator system of claim 15, wherein while in the disengaged position, the outer diameter side of the seal comprises:

annular side-by-side concave surfaces;

an annular intermediate region between the concave surfaces, the intermediate region being convex and having an outer diameter greater than outer diameters of the concave surfaces; and wherein the transverse holes extend through the intermediate region.

17. A method for performing a specified function with a drill string, the method comprising:

providing a housing with a cylindrical external region, a longitudinal axis, an actuator within the housing, and an actuating fluid passage leading from a chamber in the housing to an inlet on the external region;

providing a ring with a circumferential internal groove, a supply fluid port extending from an exterior portion of the ring through the ring to the groove, and an annular seal inside the groove, the seal having an outer diameter side and an inner diameter side, the seal having at least one transverse hole extending through the seal transverse to the axis from the outer diameter side to the inner diameter side;

mounting the ring on the housing with the internal groove surrounding the external region and spaced radially outward from the inlet, and the inner diameter side of the seal in a disengaged position spaced radially outward from and facing the external region, and the supply fluid port, the transverse hole, and the actuating fluid passage in fluid communication with each other;

mounting the housing to the drill string, rotating the drill string and the housing, and preventing the ring from rotating with the drill string;

applying fluid under pressure to the supply fluid port of the ring and causing the fluid pressure to act on the outer diameter side of the seal to push the seal into an engaged position with the inner diameter side of the seal into sealing contact with the external region; and flowing the fluid under pressure from the supply fluid port through the transverse hole and the actuating fluid passage to the chamber to cause the actuator to perform the specified function.

18. The method of claim 17, further comprising:

removing the fluid under pressure from the supply fluid port in the ring, which allows the seal to resiliently move radially outward such that the inner diameter side no longer sealingly contacts the external region.

19. The method of claim 17, wherein:

providing the seal inside the groove comprises sealingly contacting upper and lower side edges of the seal to upper and lower side walls, respectively, of the groove while the seal is in the disengaged position.

20. The method of claim 17, wherein:

the inner diameter side of the seal comprises two side-by-side convex annular lobes separated by a valley;

the transverse hole extends to the valley;

while in the engaged position, the lobes sealingly engage the external region above and below the inlet of the actuating fluid passage, and the valley is spaced radially from the inlet of the actuating fluid passage; and flowing the fluid under pressure through the transverse hole while the seal is in the engaged position causes an annular cavity to form between the valley and the external region.

* * * * *